US008997726B2

(12) United States Patent
Eser et al.

(10) Patent No.: US 8,997,726 B2
(45) Date of Patent: Apr. 7, 2015

(54) METHOD FOR DIAGNOSING A LIQUID-COOLED EXHAUST MANIFOLD OF AN INTERNAL COMBUSTION ENGINE

(75) Inventors: Gerhard Eser, Hemau (DE); Paul Rodatz, Landshut (DE)

(73) Assignee: Continental Automotive GmbH, Hannover (DE)

( * ) Notice: Subject to any disclaimer, the term of this patent is extended or adjusted under 35 U.S.C. 154(b) by 391 days.

(21) Appl. No.: 13/636,838

(22) PCT Filed: Mar. 15, 2011

(86) PCT No.: PCT/EP2011/053879

§ 371 (c)(1),
(2), (4) Date: Sep. 24, 2012

(87) PCT Pub. No.: WO2011/117112

PCT Pub. Date: Sep. 29, 2011

(65) Prior Publication Data

US 2013/0013169 A1 Jan. 10, 2013

(30) Foreign Application Priority Data

Mar. 26, 2010 (DE) ..... 10 2010 012988

(51) Int. Cl.
*F02D 41/22* (2006.01)
*F02D 41/14* (2006.01)
*F01N 3/04* (2006.01)

(52) U.S. Cl.
CPC ..... *F02D 41/1454* (2013.01); *F01N 3/046* (2013.01); *F01P 2060/16* (2013.01)

(58) Field of Classification Search
CPC . F02D 41/1446; F02D 41/1447; F01N 3/046; F01P 2060/16
USPC ..... 123/672, 676, 697, 142.5 E; 701/109, 701/110; 60/286, 320, 321
See application file for complete search history.

(56) References Cited

U.S. PATENT DOCUMENTS 6,476,364 B1 * 11/2002 Shimamura et al. ..... 219/494
7,036,351 B2 * 5/2006 Smith ..... 73/23.2

(Continued)

FOREIGN PATENT DOCUMENTS

DE 4339692 A1 5/1995 ..... F02D 41/14
DE 19625899 A1 1/1998 ..... F02D 41/14

(Continued)

OTHER PUBLICATIONS

German Office Action, Application No. 10 2010 012 988.7-13, 2 pages, Oct. 11, 2010.

(Continued)

*Primary Examiner* — Hai Huynh
(74) *Attorney, Agent, or Firm* — King & Spalding L.L.P.

(57) ABSTRACT

A method is provided for checking the functional capacity of a liquid-cooled exhaust manifold of an internal combustion engine, having an exhaust line connected to the exhaust manifold, in the course of which an exhaust gas sensor having an electrical heater is arranged. During the operation of the internal combustion engine, the electrical resistance of the exhaust gas sensor is determined, on the basis of which the current value of the exhaust gas temperature is evaluated, and compared to a target value of the exhaust gas temperature, which is expected at this point in the operation of the internal combustion engine. Depending on the result of the comparison, the functional capacity of the liquid-cooling of the exhaust manifold is estimated.

20 Claims, 3 Drawing Sheets

(56) References Cited

U.S. PATENT DOCUMENTS

| | | | | |
|---|---|---|---|---|
| 7,467,628 | B2 * | 12/2008 | Adams et al. | 123/697 |
| 7,726,117 | B2 | 6/2010 | Haft | 60/285 |
| 7,976,801 | B2 * | 7/2011 | Kammel | 423/212 |
| 2008/0178856 | A1 | 7/2008 | Adams et al. | 123/697 |
| 2009/0139317 | A1 | 6/2009 | Deivasigamani | 73/114.31 |
| 2013/0013169 | A1 | 1/2013 | Eser et al. | 701/102 |

FOREIGN PATENT DOCUMENTS

| | | | | |
|---|---|---|---|---|
| DE | 10201465 | B4 | 8/2003 | F01N 11/00 |
| DE | 102004033394 | B3 | 12/2005 | F02F 41/02 |
| DE | 102007050259 | A1 | 4/2009 | F01P 3/22 |
| DE | 102009020804 | A1 | 12/2009 | F01P 11/16 |
| GB | 2314634 | A | 1/1998 | F02D 41/14 |
| GB | 2428739 | A | 2/2007 | F01N 13/08 |
| JP | 3179122 | A | 8/1991 | F01N 3/20 |
| JP | 2004132305 | A | 4/2004 | B63H 20/00 |
| JP | 2006057551 | A | 3/2006 | F01N 13/10 |
| WO | 2011/117112 | A1 | 9/2011 | F01N 3/04 |

OTHER PUBLICATIONS

International Search Report and Written Opinion, Application No. PCT/EP2011/053879, 14 pages, Jul. 1, 2011.

* cited by examiner

METHOD FOR DIAGNOSING A LIQUID-COOLED EXHAUST MANIFOLD OF AN INTERNAL COMBUSTION ENGINE

CROSS-REFERENCE TO RELATED APPLICATIONS

This application is a U.S. National Stage Application of International Application No. PCT/EP2011/053879 filed Mar. 15, 2011, which designates the United States of America, and claims priority to German Application No. 10 2010 012 988.7 filed Mar. 26, 2010, the contents of which are hereby incorporated by reference in their entirety.

TECHNICAL FIELD

This disclosure relates to a method for diagnosing a liquid-cooled exhaust manifold of an internal combustion engine having an exhaust line which is connected to the exhaust manifold and in the course of which there is arranged an exhaust-gas sensor which is provided with an electric heating device.

BACKGROUND

During the operation of an internal combustion engine, in particular an internal combustion engine for driving high-performance motor vehicles, very high temperatures, sometimes exceeding 1000° C., can arise at the exhaust-gas side. Suitable measures must be implemented to prevent thermal damage to components provided in the exhaust tract, in particular close-coupled exhaust-gas catalytic converters, turbines of an exhaust-gas turbocharger or exhaust-gas probes.

DE 102 01 465 B4 discloses a method for controlling a component protection function for an exhaust-gas catalytic converter of an internal combustion engine having an engine controller which contains an exhaust-gas temperature model.

The exhaust-gas temperature model has a characteristic curve which represents an influencing factor on the exhaust-gas model temperature as a function of the air ratio lambda. An inverse exhaust-gas temperature model is provided, wherein the characteristic curve of the exhaust-gas temperature model is transformed into an inverted characteristic curve for the inverse exhaust-gas temperature model. A lambda setpoint value for the component protection is calculated as an input variable for a lambda coordination on the basis of the inverse exhaust-gas temperature model, wherein a component-critical limit value is used in the inverse temperature model.

DE 10 2004 033 394 B3 describes a method for controlling an internal combustion engine having an engine controller, wherein the engine controller sets the exhaust-gas temperature by means of the air/fuel mixture and has a temperature model which determines, for a component in the exhaust tract, a predicted temperature which will be assumed if the present operating and driving conditions are maintained for a relatively long period of time. For the component protection, the engine controller regulates the exhaust-gas temperature as a function of the predicted temperature.

Furthermore, it is known to replace a naturally aspirated engine with a supercharged engine of smaller swept volume. This so-called downsizing by means of turbocharging leads to a more expedient power-to-weight ratio and therefore a changed load collective, that is to say the operating duration spent in relatively high load ranges increases considerably. To limit associated thermal loading of components (exhaust-gas catalytic converter, exhaust-gas probe, exhaust-gas turbine) arranged in the exhaust tract, it is possible to use-liquid-cooled exhaust manifolds which are partially or even completely integrated into the cylinder head of the internal combustion engine.

DE 10 2007 050 259 A1 describes a supercharged internal combustion engine with integrated exhaust manifold and liquid-type cooling arrangement.

The exhaust-gas temperatures can be reduced through the use of a liquid-cooled exhaust manifold. The liquid-type cooling arrangement may be connected to the general cooling circuit of the internal combustion engine and activated by means of corresponding valves or by means of a pump. Owing to a multiplicity of possible defects of components of said cooling circuit, a failure of the liquid-type cooling arrangement of the exhaust manifold cannot be ruled out. Said failure in turn results in an increase in the exhaust-gas temperature and therefore, under some circumstances, damage to the components at the exhaust-gas side.

SUMMARY

In one embodiment, a method is provided for testing the functionality of a liquid-cooled exhaust manifold of an internal combustion engine having an exhaust line which is connected to the exhaust manifold and in the course of which there is arranged an exhaust-gas sensor which is provided with an electric heating device, wherein during the operation of the internal combustion engine, the electrical resistance of the exhaust-gas sensor is determined, on the basis of which electrical resistance the present value of the exhaust-gas temperature is estimated, said value of the exhaust-gas temperature is compared with a setpoint value for the exhaust-gas temperature expected at said operating point of the internal combustion engine, the functionality of the liquid-type cooling arrangement of the exhaust manifold is evaluated as a function of the result of the comparison.

In a further embodiment, the magnitude of the difference between the setpoint value of the exhaust-gas temperature and the estimated value of the exhaust-gas temperature is formed, the value thus attained is compared with a predefined threshold value, and a defect of the liquid-type cooling arrangement for the exhaust manifold is inferred if the magnitude exceeds the threshold value. In a further embodiment, the electrical resistance is measured and values of the exhaust-gas temperature are stored in a characteristic map of a data memory of a control device, which controls and/or regulates the internal combustion engine, as a function of the measured values of the electrical resistance. In a further embodiment, the setpoint value of the exhaust-gas temperature is determined experimentally as a function of the load and rotational speed of the internal combustion engine and is stored in a characteristic map of a data memory of a control device which controls and/or regulates the internal combustion engine. In a further embodiment, the setpoint value of the exhaust-gas temperature is obtained by means of physical or empirical modeling. In a further embodiment, the method is carried out only when predefined enable conditions for the diagnosis of the liquid-cooled exhaust manifold are met. In a further embodiment, after a cold start of the internal combustion engine has taken place, it is checked whether the electrical resistance of the exhaust-gas sensor lies within a predefined range, and if said condition is met, the diagnosis is enabled. In a further embodiment, it is checked whether the internal combustion engine is in a predefined load/rotational speed range, and if said condition is met, the diagnosis is enabled. In a further embodiment, in the event of an occurrence of a malfunction of the cooling system for the exhaust manifold, power-limiting interventions which reduce the input of energy into the exhaust line are initiated by means of the control device. In a further embodiment, a fault entry is recorded in a fault memory of the control device, and a visual and/or audible warning message is output to the driver of the vehicle driven by the internal combustion engine.

BRIEF DESCRIPTION OF THE DRAWINGS

Example embodiments will be explained in more detail below with reference to figures, in which.

DETAILED DESCRIPTION

Figure 1:
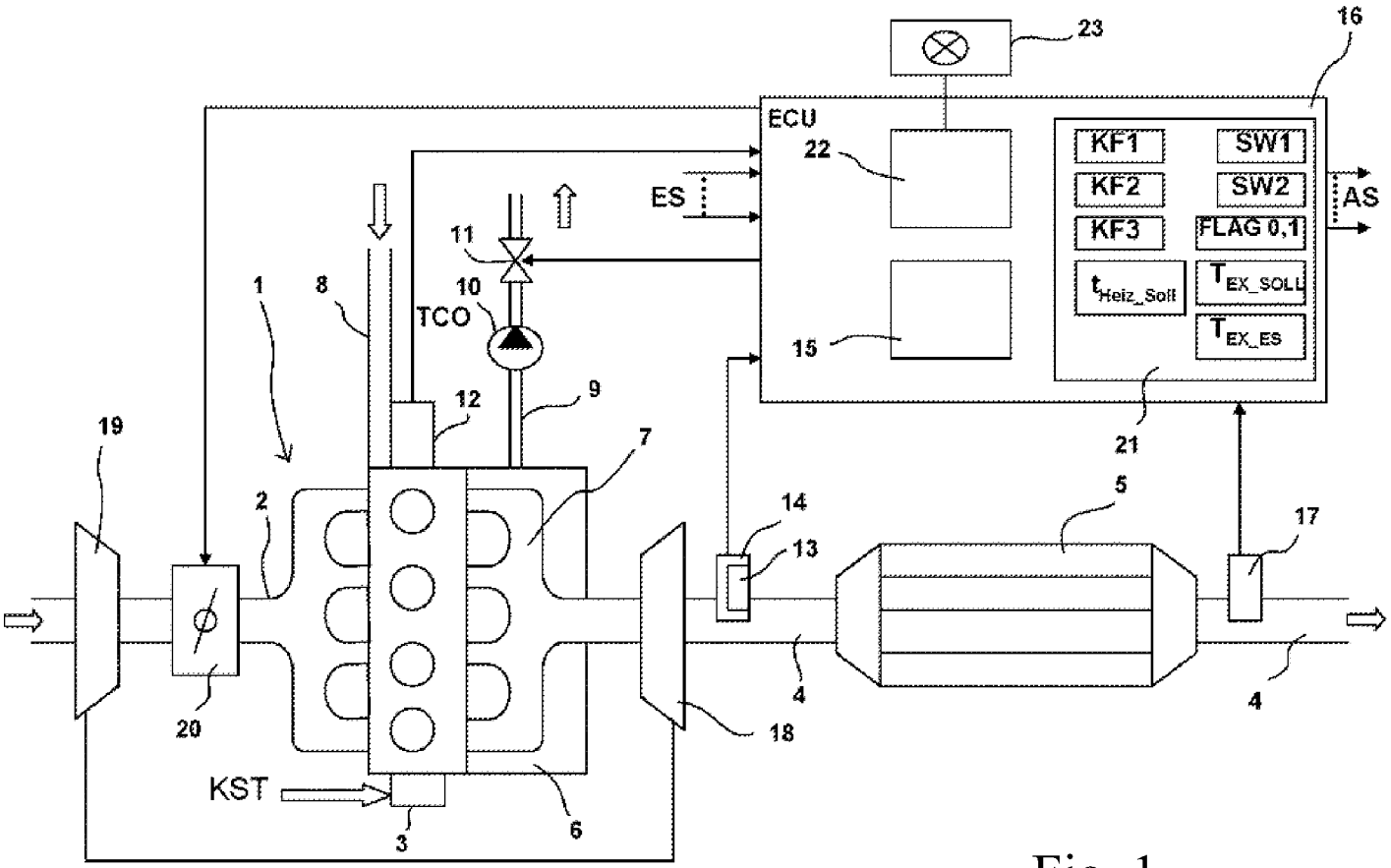
FIG. 1 shows a block diagram of an internal combustion engine having a liquid-cooled exhaust manifold and associated exhaust-gas purification device, in which a diagnosis method according to an example embodiment is used.

Some embodiments provide a method by means of which, in a simple manner, the correct functioning of a liquid-type cooling arrangement for an exhaust manifold of an internal combustion engine can be diagnosed.

For example, some embodiments provide a method for testing the functionality of a liquid-cooled exhaust manifold of an internal combustion engine having an exhaust line which is connected to the exhaust manifold and in the course of which there is arranged an exhaust-gas sensor which is provided with an electric heating device, wherein during the operation of the internal combustion engine, the electrical resistance of the exhaust-gas sensor is determined, on the basis of which electrical resistance the present value of the exhaust-gas temperature is estimated, said value of the exhaust-gas temperature is compared with a setpoint value for the exhaust-gas temperature expected at said operating point of the internal combustion engine, and the functionality of the liquid-type cooling arrangement of the exhaust manifold is evaluated as a function of the result of the comparison.

By measuring and evaluating the electrical resistance, which is dependent on the temperature of the exhaust gas, of the exhaust-gas sensor, it is possible in a simple manner, without the use of additional components, to obtain a statement regarding the operational readiness of the liquid-type cooling arrangement of the exhaust manifold. In particular, it is possible to dispense with the installation of an exhaust-gas temperature sensor into the exhaust tract downstream of the exhaust manifold, which leads to a reduction in costs.

In one embodiment, the magnitude of the difference between the setpoint value of the exhaust-gas temperature and the estimated value of the exhaust-gas temperature is formed, and the value thus attained is compared with a predefined threshold value. A defect of the liquid-type cooling arrangement for the exhaust manifold is inferred if the magnitude exceeds the threshold value. This permits a particularly simple evaluation which saves on processing resources.

Since the electrical resistance of the exhaust-gas sensor is dependent primarily on the exhaust-gas temperature, it is possible, for a reference system, that is to say for a system in which the liquid-type cooling arrangement is functioning correctly, for said relationship to be for example empirically determined as a function of load and rotational speed and stored in a characteristic map of a data memory of a control device which controls and/or regulates the internal combustion engine. Here, the electrical resistance can be obtained by means of simple current and voltage measurement.

In one embodiment, the setpoint value of the exhaust-gas temperature is likewise determined experimentally as a function of the load and rotational speed of the internal combustion engine and stored in a characteristic map of a data memory of a control device which controls and/or regulates the internal combustion engine.

Furthermore, the setpoint value of the exhaust-gas temperature may also be obtained by means of physical or empirical modeling, with operating parameters of the internal combustion engine being taken into consideration.

In a further embodiment, the method is carried out only when predefined enable conditions for the diagnosis of the liquid-cooled exhaust manifold are met. It is thus possible for incorrect diagnoses to be reliably avoided.

Since a deviation between the setpoint value of the exhaust-gas temperature and the estimated value of the exhaust-gas temperature may be based not only on the temperature change caused by the liquid-type cooling arrangement but also on a defect or a change in the probe resistance not caused by the exhaust-gas temperature, in one embodiment it is checked whether an abnormality of the probe resistance is present.

Such a check may take place after a cold start of the internal combustion engine has taken place, because during the cold start, the influence of the liquid-type cooling arrangement can be neglected. Here, it is checked whether the heating-up time from a first temperature value to a second temperature value lies within a predefined range and therefore the electrical resistance also lies within a predefined range. Only if this condition is met is the diagnosis enabled.

It may additionally be checked whether the internal combustion engine is in a predefined load/rotational speed range, and the diagnosis may be enabled only if said condition is also met. This leads to an even more meaningful diagnosis result, because the minimum and maximum temperatures occurring at idle and full load respectively can possibly distort the evaluation.

In a further embodiment, in the event of an occurrence of a malfunction of the cooling system for the exhaust manifold, power-limiting interventions which prevent or reduce a further input of energy into the exhaust line are initiated by means of the control device. In this way, it is possible for components in the exhaust tract, such as for example the exhaust-gas catalytic converter or the turbine of the exhaust-gas turbocharger or also exhaust-gas sensors, to be protected against thermal damage or even destruction in an effective manner.

After a malfunction of the liquid-type cooling arrangement is detected, a fault entry is recorded in a fault memory of the control device, and a visual and/or audible warning message is output to the driver of the vehicle driven by the internal combustion engine. This may take place in a simple manner through the activation of a warning lamp within an already existing display. In this way, the driver is prompted to find a workshop, and the fault is read out of the fault memory and can be resolved.

FIG. 1 shows, in a highly simplified manner in the form of a block diagram, an internal combustion engine having an exhaust-gas purification device assigned thereto.

The air required for combustion is supplied to the internal combustion engine 1 via an intake tract 2. An injection system, which may for example be in the form of a high-pressure accumulator injection system (common rail) with injection valves which inject fuel KST directly into the cylinders of the internal combustion engine 1, is denoted by the reference numeral 3. The exhaust gas of the internal combustion engine 1 flows via an exhaust line 4 to an exhaust-gas catalytic converter 5, and from the latter into the environment via a silencer (not illustrated). It is also possible for a plurality of exhaust-gas catalytic converters to be provided, in particular a close-coupled pre-catalytic converter and a so-called underfloor catalytic converter.

During the operation of the internal combustion engine 1, the exhaust gas flows through the exhaust line 4 in the arrow direction indicated.

The internal combustion engine 1 has a liquid-cooled cylinder head 6 and an exhaust manifold 7 which is at least partially integrated into the cylinder head 6. Here, the configuration of the cooling circuit is such that cooling liquid also reaches the exhaust manifold 7 and the latter is also cooled as required. For this purpose, a coolant inlet 8 and a coolant outlet 9 are provided on the cylinder head 6. The flow direction of the coolant is denoted by arrow symbols. An electrically controllable coolant pump 10 and/or an electrically controllable valve 11 may be provided at the coolant outlet 9, such that the coolant flow through the cylinder block 2 and the exhaust manifold 7 can be actively influenced. It is also possible for two coolant circuits which are separate at least in sections to be provided for the cylinder head 6 and the exhaust manifold 7, such that the coolant flow through the exhaust manifold 7 can be set independently of the coolant flow through the cylinder head 6. At or in the vicinity of the coolant inlet 8, there is arranged a temperature sensor 12 which outputs a signal TCO corresponding to the temperature of the coolant.

An exhaust-gas sensor 14 which is equipped with an electric heating device 13 and which may comprise a linear lambda probe (broad-band lambda probe) is provided in the exhaust duct 4 upstream of the exhaust-gas catalytic converter 5. The exhaust-gas sensor 14 may alternatively also be in the form of a binary lambda probe. The exhaust-gas sensor 14 measures a residual oxygen content in the exhaust gas and outputs a corresponding signal. With the signal from said exhaust-gas sensor 14, the mixture of the internal combustion engine 1 is regulated in accordance with the setpoint values. This function is performed by a lambda regulating device such as is known per se.

To control and regulate the internal combustion engine 1, a control device (ECU, Electronic Control Unit) 16 is provided which is assigned not only the signals of the said sensors but also further sensors which are required for the operation of the internal combustion engine 1. These are in particular a crankshaft angle sensor, which measures a crankshaft angle and then assigns a rotational speed thereto, an accelerator pedal position sensor which measures an accelerator pedal position of an accelerator pedal, and a temperature sensor which measures the intake air temperature. Further input signals from sensors which are required for the control and regulation of the internal combustion engine 1 are denoted in FIG. 1 generally by the reference symbol ES.

The sensors measure different measurement variables and determine in each case the measurement value of the measurement variable. The control device 16 determines actuating variables as a function of at least one of the measurement variables, which actuating variables are then converted into one or more actuating signals for controlling actuating elements by means of corresponding actuating drives.

The actuating elements are for example a throttle flap 20 in the intake tract 4 and the injection valves of the injection system 3, the coolant pump 10 and the valve 11. Further output signals for further actuating elements which are required for the operation of the internal combustion engine 1 but which are not explicitly illustrated are denoted in FIG. 1 generally by the reference symbol AS.

Such electronic control devices 16, which generally comprise one or more microprocessors and which, aside from the fuel injection, the lambda regulation and the ignition regulation in the case of an applied-ignition engine, also perform a multiplicity of further control and regulating tasks and in particular also on-board diagnosis, are known per se.

In the control device 16, a plurality of characteristic-map-based engine control functions are implemented in terms of software in a program memory 15. Implemented inter alia are in particular the lambda regulating device and a model for determining the exhaust-gas temperature, and also component protection functions for components in the exhaust line. In the case of an applied-ignition engine, the fuel injection quantity required for combustion is calculated in the conventional way from a load parameter, for example the intake air mass or air quantity and the rotational speed, and subjected to several corrections (temperature influences, lambda regulator, etc.).

The control device 16 comprises in particular a data memory 21 in which there are stored inter alia various characteristic maps $KF_i$, threshold values $SW_i$, actual values $T_{EX_ES}$ and setpoint values $t_{HEIZ_SOLL}$, $t_{EX_SOLL}$ and also flags FLAG 0,1, the meaning of which will be explained below.

The control device 16 also comprises a fault memory 22 in which faults detected by means of the on-board diagnosis are recorded and from which said faults can be read out during the next workshop visit. The occurrence of a fault can be communicated to the vehicle driver audibly and/or visually. For this purpose, the fault memory 22 is connected to a fault display 23, which may for example include a warning lamp (MIL, malfunction indication lamp).

Provided in the exhaust duct 4 downstream of the exhaust-gas catalytic converter 5 is a further exhaust-gas sensor 17, e.g., a binary lambda probe (step probe). The signal from said exhaust-gas sensor 17 is used during the course of trimming regulation, also referred to as guide regulation, for the correction (trimming) of the output signal of the exhaust-gas sensor 14. Said signal may furthermore be used for determining the loading and for the diagnosis of the exhaust-gas catalytic converter 5.

To increase the cylinder charge and thus to improve the performance of the internal combustion engine 1, a supercharging device in the form of an exhaust-gas turbocharger such as is known per se is provided, the turbine 18 of which is arranged in the exhaust duct 4 close to the exhaust manifold and therefore close to the cylinder head 6, said turbine being operatively connected via a mechanical connection which is illustrated merely as a line and which is not shown in any more detail, in particular via a shaft, to a compressor 19, which is arranged upstream of the throttle flap 20, in the intake duct 2. The exhaust gases of the internal combustion engine 1 thus drive the turbine 18, and the latter in turn drives the compressor 19. The compressor 19 performs the task of induction and delivers a pre-compressed fresh charge to the internal combustion engine 1. Further components of the supercharging device, such as charge-air cooler, bypass lines with wastegate or overrun air recirculation valve etc., are not illustrated.

To check the functionality of the liquid-type cooling arrangement of the exhaust manifold 7 of the internal combustion engine 1, there is stored in the program memory 15 of the control device 16 a program which is executed during the operation of the internal combustion engine 1.

The program is started in a step S0 (FIG. 2) in which, if appropriate, variables are initialized. The start of the program may take place close in terms of time to the starting of the internal combustion engine 1.

Figure 3:
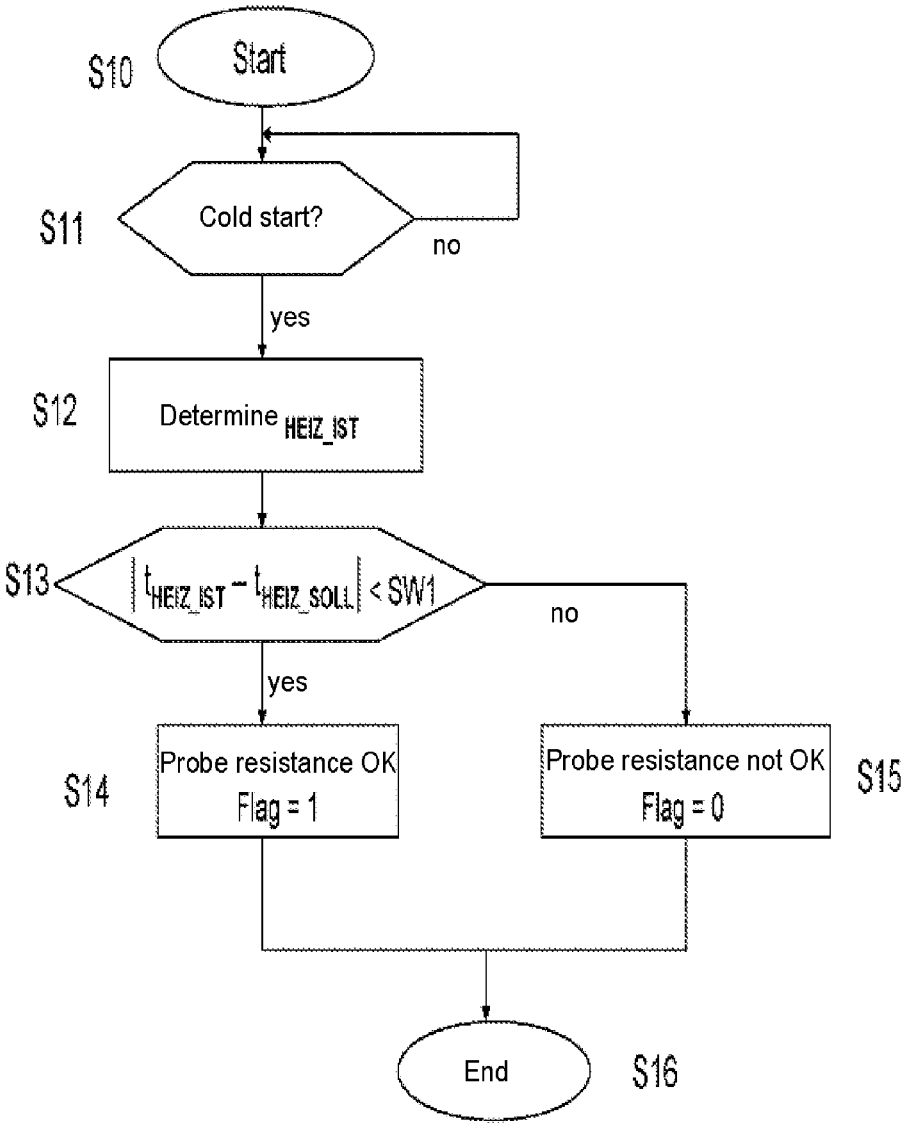
FIG. 3 shows a flow diagram for the checking of a diagnosis condition.

In a step S1, it is queried whether a flag FLAG=1 or FLAG=0 is set in the data memory 21. The flag FLAG=1 means that predefined diagnosis conditions are met and the diagnosis can be performed. The flag FLAG=0 means that the predefined diagnosis conditions are not met and therefore the diagnosis is blocked. One diagnosis condition is in particular that the heating-up duration of an exhaust-gas sensor 14 arranged in the exhaust duct 4 downstream of the exhaust manifold 7, and therefore the electric probe resistance of the exhaust-gas sensor 14, lies in an admissible range. Said check will be explained in more detail on the basis of the description of FIG. 3. It is additionally or optionally possible for the check to be restricted to a certain rotational speed/load range of the internal combustion engine 1.

If the query in step S1 yields that a flag FLAG=0 is set, then the method ends at step S7 and the method starts again either automatically after a certain predefined time period or only upon the next start-up of the internal combustion engine.

By contrast, if a flag FLAG=1 is set in step S1, then in a subsequent step S2, a value for an estimated exhaust-gas temperature $T_{EX_ES}$ and a setpoint value for the exhaust-gas temperature $T_{EX_SOLL}$ are read into the program memory 15 of the internal combustion engine. The estimated value of the exhaust-gas temperature $T_{EX_ES}$ is read out of a characteristic map KF1 which is stored in the data memory 21 of the control device 16. Associated values for the exhaust-gas temperature $T_{EX_ES}$ are stored in said characteristic map KF1 as a function of the electrical resistance of the Nernst cell (internal resistance) of the exhaust-gas sensor 14. The temperature at the probe tip can be determined on the basis of the resistance of the Nernst cell of the exhaust-gas sensor 14. Said temperature is in turn dependent on the exhaust-gas temperature and on the exhaust-gas mass flow rate. The relationship between said variables is determined experimentally. One possibility for the determination of the electrical resistance (internal resistance) of an exhaust-gas sensor is described in DE 196 25 899 C2.

The setpoint value of the exhaust-gas temperature $T_{EX_SOLL}$ is read out of a characteristic map KF2 which is likewise stored in the data memory 21 of the control device 16. Associated setpoint values for the exhaust-gas temperature $T_{EX_SOLL}$ are stored as a function of the load and the rotational speed of the internal combustion engine 1. It is optionally possible for corrective factors (ignition angle, lambda regulation signal) to also be taken into consideration. The data of the characteristic map KF2 is determined experimentally by means of tests or by means of a temperature sensor. The temperature thus determined corresponds to a reference system in the case of a fault-free cooling system of the exhaust manifold.

In a step S3, the magnitude of the difference between the setpoint value of the exhaust-gas temperature $T_{EX_SOLL}$ and the estimated value of the exhaust-gas temperature $T_{EX_ES}$ is formed and compared with a predefined threshold value SW1. If said magnitude exceeds the threshold value SW1, then in step S4, a failure of the liquid-type cooling arrangement for the exhaust manifold 7 is inferred, and in reaction thereto, in a subsequent step S5, suitable measures for lowering the exhaust-gas temperature are initiated in order to protect the components in the exhaust line 4 against excessive thermal loading. Any power-limiting interventions which reduce the energy input into the exhaust tract are suitable for this purpose. In particular, in the case of a supercharged internal combustion engine, a limitation of the charge pressure may be realized. It is for example also possible for the air/fuel ratio to be adjusted in the direction of an excess of fuel, that is to say a so-called enrichment of the mixture (air ratio lambda >1).

At the same time as this, in the step S6, a fault entry is recorded in the fault memory 22 of the control device 16 and the failure of the liquid-type cooling arrangement can be audibly and/or visually indicated to the driver of the vehicle driven by means of the internal combustion engine 1, thus prompting him to visit a workshop. After the fault is recorded and the warning indication is output, the method ends in step S7.

If the query in step S3 yields that the threshold value SW1 is not exceeded, then it is inferred that the liquid-type cooling arrangement of the exhaust manifold 7 is functional (step S5) and the method is ended in step S7.

Aside from the temperature change effected by the liquid-type cooling arrangement, a deviation between the setpoint value of the exhaust-gas temperature $T_{EX_SOLL}$ and the estimated value of the exhaust-gas temperature $T_{EX_ES}$ may furthermore be based on a defect or a change in the probe resistance not caused by the exhaust-gas temperature. To rule out an incorrect diagnosis, it must be ensured that there is no abnormality of the probe resistance.

Therefore, in the program memory 15 of the control device 16, there is stored a further program (FIG. 3) which allows a statement to be made regarding the state of the probe resistance of the exhaust-gas sensor 14.

The program is started in a step S10, in which variables are initialized if appropriate. The start of the program takes place directly after the starting of the internal combustion engine 1.

In a step S11, it is checked whether a cold start of the internal combustion engine 1 is present. For this purpose, it is for example possible for the signal TCO of the temperature sensor 12 (FIG. 1) and/or the shut-down time duration of the internal combustion engine 1 to be evaluated.

If the measured temperature, or temperature determined by means of a temperature model such as is known per se, of the internal combustion engine lies below a predefined value, a cold start of the internal combustion engine 1 is inferred and the method is continued in a step S12, said condition otherwise being queried again in a waiting loop.

In the step S12, the heating-up duration $t_{HEIZ_IST}$ of the exhaust-gas sensor 14 is determined, that is to say the time duration required for the exhaust-gas sensor 14 to be heated from a first predefined temperature value to a second likewise predefined temperature value by means of the electric heating device 13 integrated in the exhaust-gas sensor 14. In a step S13, the magnitude of the difference between the heating-up duration $t_{HEIZ_IST}$ thus determined and a predefined setpoint value for the heating-up duration $t_{HEIZ_SOLL}$ is formed and compared with a predefined threshold value SW1. If the magnitude of the difference between the heating-up duration $t_{HEIZ_IST}$ and the setpoint value for the heating-up time $t_{HEIZ_SOLL}$ lies below the threshold value SW1, then in the step S14, it is inferred that a probe resistance lies within a tolerable range, and a flag FLAG=1 is set in the data memory 21. The method is subsequently ended in a step S16. If the probe resistance lies within the defined range, then a change in the probe resistance can be inferred, because in the case of a cold start of the internal combustion engine 1, the influence of the liquid-type cooling arrangement can be neglected.

If the query in step S13 yields a negative result, then in step S15, it is inferred that a probe resistance no longer lies within a tolerable range, and a flag FLAG=0 is set in the data memory 21. The method is subsequently ended in step S16.

Figure 2:
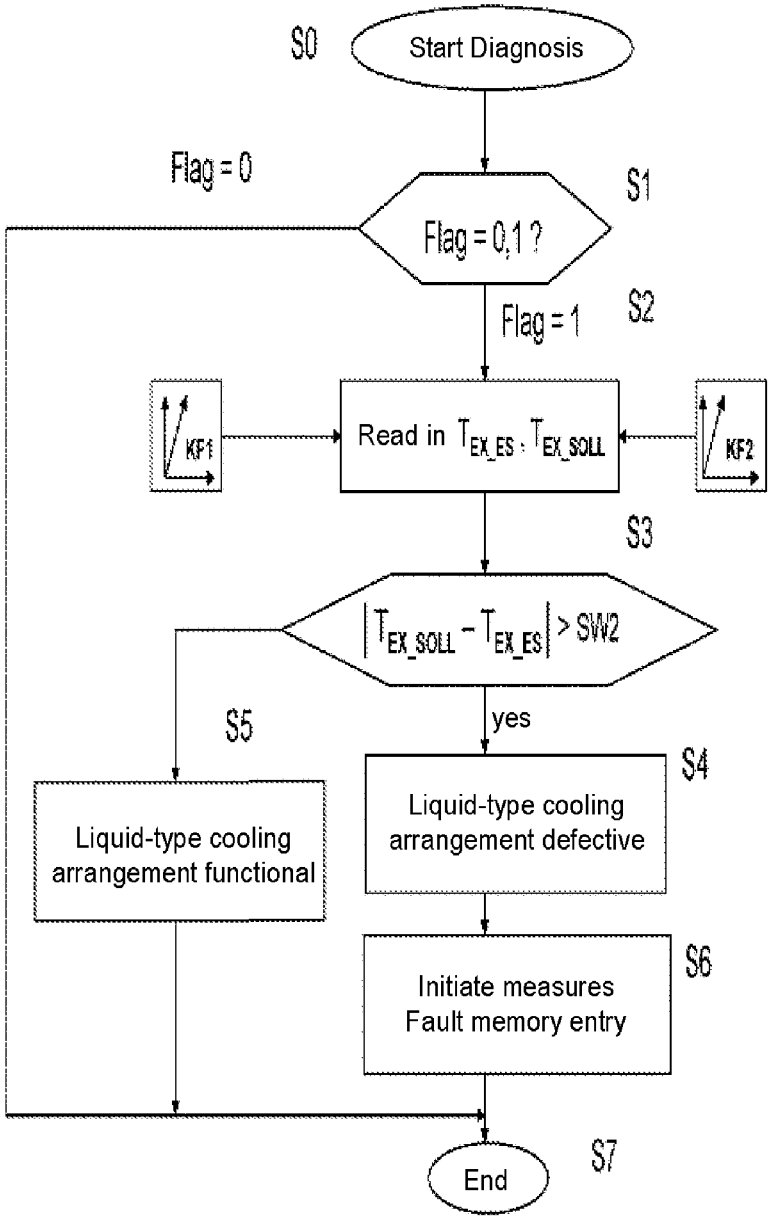
FIG. 2 shows a flow diagram of the diagnosis method according to an example embodiment.

The flag FLAG=1 is thus an indicator that the diagnosis according to the method as described on the basis of the flow diagram of FIG. 2 can be performed, whereas the flag FLAG=0 means that the diagnosis is blocked, because no meaningful result regarding the functionality of the liquid-type cooling arrangement of the exhaust manifold can be expected.

What is claimed is:

1. A method for testing the functionality of a liquid-cooled exhaust manifold of an internal combustion engine having an exhaust line connected to the exhaust manifold and an exhaust-gas sensor provided with an electric heating device, comprising:

determining an electrical resistance of the exhaust-gas sensor during the operation of the internal combustion engine, estimating a present value of an exhaust-gas temperature based on the determined electrical resistance of the exhaust-gas sensor, comparing the estimated present value of the exhaust-gas temperature with a setpoint value for the exhaust-gas temperature expected at an operating point of the internal combustion engine, and evaluating a functionality of the liquid-type cooling arrangement of the exhaust manifold based on the result of the comparison.

2. The method of claim 1, comprising:

determining a difference between the setpoint value of the exhaust-gas temperature and the estimated value of the exhaust-gas temperature, comparing the determined difference with a predefined threshold value, and identifying the presence of a defect of the liquid-type cooling arrangement for the exhaust manifold if the magnitude exceeds the threshold value.

3. The method of claim 1, comprising storing the determined electrical resistance and the values of the exhaust-gas temperature in a characteristic map in a data memory of a control device configured to control the internal combustion engine based on the determined electrical resistance.

4. The method of claim 1, wherein the setpoint value of the exhaust-gas temperature is determined experimentally as a function of a load and a rotational speed of the internal combustion engine and stored in a characteristic map in a data memory of a control device of the internal combustion engine.

5. The method of claim 1, wherein the setpoint value of the exhaust-gas temperature is obtained by physical or empirical modeling.

6. The method of claim 1, wherein the method is carried out in response to an identification of the presence of predefined enable conditions for the diagnosis of the liquid-cooled exhaust manifold.

7. The method of claim 6, comprising, after a cold start of the internal combustion engine has taken place, checking whether the electrical resistance of the exhaust-gas sensor lies within a predefined range, and enabling the diagnosis in response to determining that the electrical resistance of the exhaust-gas sensor lies within the predefined range.

8. The method of claim 7, comprising checking whether the internal combustion engine is in a predefined load/rotational speed range, and enabling the diagnosis in response to determining that the internal combustion engine is in the predefined load/rotational speed range.

9. The method of claim 1, comprising automatically initiating power-limiting interventions that reduce that input of energy into the exhaust line in response to, an occurrence of a malfunction of the cooling system for the exhaust manifold.

10. The method of claim 9, comprising:

recording a fault entry in a fault memory of the control device, and outputting a visual and/or audible warning message a driver of the vehicle.

11. Logic instructions for evaluating the functionality of a liquid-cooled exhaust manifold of an internal combustion engine having an exhaust line connected to the exhaust manifold and an exhaust-gas sensor provided with an electric heating device, the logic instruction stored in non-transitory computer-readable media and executable by a process to:

determine an electrical resistance of the exhaust-gas sensor during the operation of the internal combustion engine, estimate a present value of an exhaust-gas temperature based on the determined electrical resistance of the exhaust-gas sensor, compare the estimated present value of the exhaust-gas temperature with a setpoint value for the exhaust-gas temperature expected at an operating point of the internal combustion engine, and evaluate a functionality of the liquid-type cooling arrangement of the exhaust manifold based on the result of the comparison.

12. The logic instructions of claim 11, further executable to:

determine a difference between the setpoint value of the exhaust-gas temperature and the estimated value of the exhaust-gas temperature, compare the determined difference with a predefined threshold value, and identify the presence of a defect of the liquid-type cooling arrangement for the exhaust manifold if the magnitude exceeds the threshold value.

13. The logic instructions of claim 11, further executable to store the determined electrical resistance and the values of the exhaust-gas temperature in a characteristic map in a data memory of a control device configured to control the internal combustion engine based on the determined electrical resistance.

14. The logic instructions of claim 11, wherein the setpoint value of the exhaust-gas temperature is determined experimentally as a function of a load and a rotational speed of the internal combustion engine and stored in a characteristic map in a data memory of a control device of the internal combustion engine.

15. The logic instructions of claim 11, wherein the setpoint value of the exhaust-gas temperature is obtained by physical or empirical modeling.

16. The logic instructions of claim 11, wherein the logic instructions are executed in response to an identification of the presence of predefined enable conditions for the diagnosis of the liquid-cooled exhaust manifold.

17. The logic instructions of claim 16, wherein the logic instructions are executable to, after a cold start of the internal combustion engine has taken place, check whether the electrical resistance of the exhaust-gas sensor lies within a predefined range, and perform the evaluation of the functionality of a liquid-cooled exhaust manifold in response to determining that the electrical resistance of the exhaust-gas sensor lies within the predefined range.

18. The logic instructions of claim 17, wherein the logic instructions are executable to check whether the internal combustion engine is in a predefined load/rotational speed range, perform the evaluation of the functionality of a liquid-cooled exhaust manifold in response to determining that the internal combustion engine is in the predefined load/rotational speed range.

19. The logic instructions of claim 11, wherein the logic instructions are executable to automatically initiate power-limiting interventions that reduce the input of energy into the exhaust line in response to an occurrence of a malfunction of the cooling system for the exhaust manifold.

20. The logic instructions of claim 19, wherein the logic instructions are executable to:

record a fault entry in a fault memory of the control device, and output a visual and/or audible warning message to a driver of the vehicle.

* * * * *